US005678713A

United States Patent [19]

Derksen

[11] Patent Number: 5,678,713

[45] Date of Patent: Oct. 21, 1997

[54] ARRANGEMENT ON INFUSION BOTTLES OR THE LIKE

[75] Inventor: Klaus Derksen, Karlsbad-Ittersbach, Germany

[73] Assignee: Pohl GmbH & Co. KG, Karlsruhe, Germany

[21] Appl. No.: 580,604

[22] Filed: Dec. 29, 1995

[30] Foreign Application Priority Data

Jan. 10, 1995 [DE] Germany ..... 195 00 460.4

[51] Int. Cl.[6] ..... B65D 51/20

[52] U.S. Cl. ..... 215/249; 215/254; 215/251

[58] Field of Search ..... 215/247, 249, 215/250, 251, 253, 254, 255

[56] References Cited

U.S. PATENT DOCUMENTS

| | | | |
|---|---|---|---|
| 2,804,224 | 8/1957 | Barton | 215/247 |
| 3,900,028 | 8/1975 | McPhee . | |
| 4,501,372 | 2/1985 | Hansen | 215/249 X |
| 5,395,365 | 3/1995 | Weiler et al. | 206/514 X |

FOREIGN PATENT DOCUMENTS

| | | |
|---|---|---|
| 0364783 | 4/1990 | European Pat. Off. . |
| 2618682 | 2/1989 | France . |
| 3310265 | 9/1984 | Germany . |

*Primary Examiner*—Allan N. Shoap
*Assistant Examiner*—Nathan Newhouse
*Attorney, Agent, or Firm*—Martin A. Farber

[57] ABSTRACT

An arrangement (A) on infusion bottles (1), or the like, having a cover (7) which has several foil-covered puncture regions (13), which cover is held by a cap (8). In order to obtain individual accessibility despite the overall covering, the cover foil (15) has an intended tear line (17) between the puncture regions (13) and forms, on both sides of the intended tear line (17), grip tabs (18) which protrude beyond the contour of the cap (8).

7 Claims, 7 Drawing Sheets

ARRANGEMENT ON INFUSION BOTTLES OR THE LIKE

FIELD AND BACKGROUND OF THE INVENTION

The present invention relates to an arrangement on infusion bottles or the like, which has a cover which has at least one foil-covered puncture region and is covered by a cap.

An arrangement of this kind is known from EP Patent 0 364 783. The cover foil there passes, in the case of several puncture regions, over all the regions or, with separate manner of closing, over one puncture region in each case. The puncture regions can therefore be exposed individually as needed for the attachment of a cannula and/or a spike.

SUMMARY OF THE INVENTION

It is an object of the present invention, while retaining the advantages of the optional accessibility at different times of the arrangement, to develop the corresponding cover foil in a manner which is more favorable for its attachment and handling. It covers, in addition to infusion bottles, also all medicine bottles with sensitive biological safety/tightness.

As a result of the development of the invention, there is obtained an arrangement of this type which is of increased value in use. The individual puncture regions need no longer be closed separately, nor need a covering which extends over all of them be accepted or used. Rather, one proceeds in the manner that the cover foil has an intended tear line between the puncture regions and forms gripping tabs which protrude beyond the contour of the cap on both sides of the intended tear line. Thus, despite the advantage of complete covering, only one puncture region need be exposed in each case. The pulling off terminates in each case sufficiently far from the border to the next puncture region. The latter can then also, in its turn, be exposed only intentionally. This leads to more reliable operation. Grasping is also facilitated as a result of the gripping tabs of the cover foil which extend freely over the periphery of the cap. The cover foil may consist of plastic. Development from aluminum or a combination thereof is also possible. The aseptically closing attachment can be achieved by means of adhesive, hot sealing, or the like. One particularly advantageous development of the sectioning of the cover foil consists therein that its intended tear line lies as an embossed line above a support crossbar formed by the cap. In that case, the body of the cap itself can form the abutment for the embossing. The embossing can be effected to such an extent that instead of the minimizing of the cross section of the material forming the cover foil which is obtainable thereby, a perforation is effected. If, furthermore, one proceeds in the manner that the support crossbar and a lateral outer edge of the cap hold the tearable cover foil spaced from the cover and from an adjoining shoulder of the arrangement, the puncture regions can even be used to form pockets which receive a disinfecting liquid and the gripping tabs can be better grasped below. Finally, it is also proposed that a crossbar of the cap extend below the cover between the puncture regions. In this way, not only is the cover, which is incorporated, for instance, by assembly molding, reliably supported towards the head of the infusion bottle, but a second abutment plane for the embossing of the line is also provided. Furthermore, the overall stability of the cap, which can even be developed with a relatively thin wall, is increased. Finally, it is also favorable that the crossbar extend substantially in the plane of the shoulder between the cap and a wall extending it. The cover which bears the puncture regions can thus be arranged in a readily accessible superstructure of the closure.

BRIEF DESCRIPTION OF THE DRAWINGS

With the above and other objects and other advantages in view, the present invention will become more clearly understood in connection with the detailed description of a preferred embodiment, when considered with the accompanying drawings of which.

DETAILED DESCRIPTION OF THE PREFERRED EMBODIMENT

Figure 1:
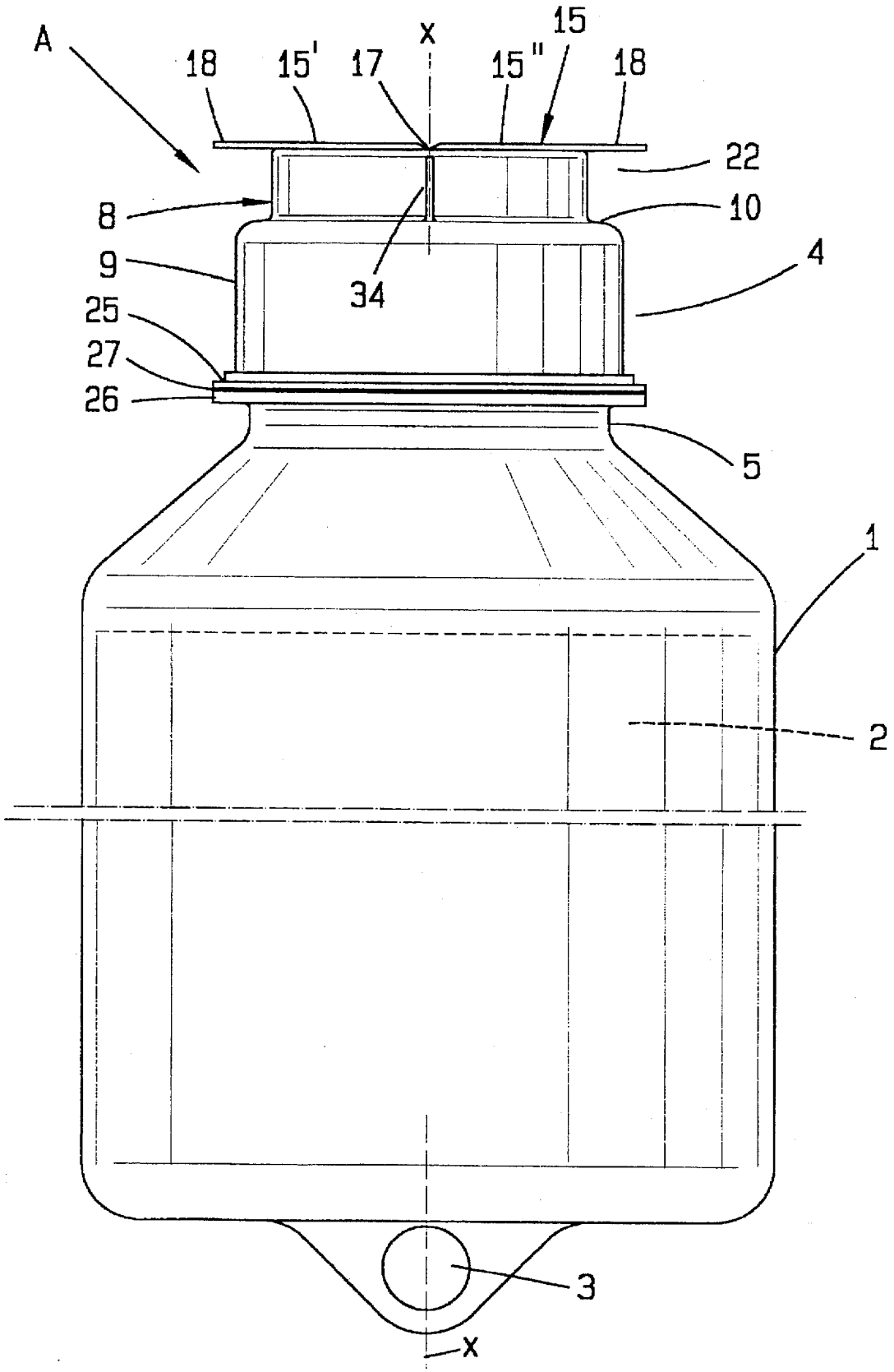
FIG. 1 shows an infusion bottle provided with the arrangement in accordance with the invention.

The arrangement A shown is present on a medical bottle or injection bottle or, as shown, on a transfusion bottle 1. The latter contains, in sterile manner or protected against germ formation, a liquid substance designated 2.

In the case of a transfusion bottle, there is generally present on its bottom, as shown, an eye 3 for the attachment of the transfusion bottle 1 upside-down, the head 4 of the bottle facing downward.

The transfusion bottle 1 is tapered in the region of its bottle head 4 so as to form a bottle neck 5 of clearly smaller cross section. The opening of the neck is closed. The corresponding closure wall bears the reference numeral 6. The body of the bottle consists of plastic, for example polyethylene, in a puncturable wall thickness. The puncturing tools are generally cannulas or spikes.

In order to dependably seal off the penetration which produces the corresponding accessibility via such tools, namely the punctured and torn surrounding hole, a cover 7 of elastic material is arranged in front of the closure wall 6. This cover can also be punctured and is arranged in front of the closure wall 6. It is held within the arrangement A and consists of elastic material, for instance TPE.

The part of the arrangement A holding it is a cap 8. It continues into a wall 9 which grips over the bottle neck 5, fitting it. The wall 9 has a greater radial extent, so that a step 10 is present at the foot of the edge of the cap. The entire arrangement has the appearance of a cap having a shoulder.

The upward-facing bottom 11 of the cap 8 is flat. It leaves at least one opening 12 for the passage of a cannula or a spike (not shown). Preferably, however, several such openings 12 are present. Two openings 12 are shown. Each of said openings 12 extends over a puncture region 13. The puncture regions 13 are reduced in thickness. This is achieved by congruently located, semi-spherical troughs 14 present in the top and bottom of the cover 7. In the region of their culmination points directed towards each other, these troughs result in a thickness which is reduced to about one-fifth of the thickness of the cover 7, and thus zones forming elastically gripping lips. As a result of the minimizing of the thickness, the frictional resistance to puncturing is furthermore reduced.

The puncture regions 13 and the openings 12 are covered with foil. The cover foil is designated 15. It can be an aluminum foil or, however, also a foil of PE or PP. The cover foil 15 is stretched over the openings 12 in the manner of a drum head and therefore does not contact the top of the cover 7. The support of the cover foil 15 is the flat top side 16 of the upward-facing bottom 11 of the cap 8.

In order now, that, when using the one puncture region 13, the other puncture region still continues to remain sterile, matters are so arranged that, despite the continuous cover foil 15, in each case only one opening 12 is exposed.

In the case of the arrangement A shown, this is achieved in the manner that the cover foil 15 has an intended tear line 17 between the puncture regions 13. The force required for the tearing is less than the force of adherence which holds the cover foil 15 on the top side. The weakest point is at 17. There can be concerned both an attachment of the cover foil 15 by adhesive as well as a thermal binding, assuming suitable corresponding materials.

In the embodiment shown, the cover foil 15 extends along the diametral line D—D of the circular bottle head 4 or the arrangement A.

By means of the intended tear line 17, there are thus produced clearly separable sections 15' and 15" of the cover foil 15.

The free ends of the cover foil 15 which face away from the intended tear line 17 form gripping tabs which protrude in a manner favorable for gripping beyond the periphery of the cap 8. Their width corresponds to that of the covering part of the sections 15', 15" of the cover foil.

In the embodiment shown, the intended tear line 17 is developed in the form of an embossed line. In accordance with what is shown in the drawing, it is developed as a V-notch 19. The sides of the V-notch 19 which go back in the direction of the top 16 of the cap 8 to a minimum bridge of material diverge in the direction away from the bottle. Instead of a practically skin-like bridge which is thus obtained, a perforation can also be employed. Even a measure which makes the material brittle along the line to be formed would be conceivable and usable in practice.

The abutment for the embossing is formed by a portion of the bottom 11 of the cap 8 which separates the openings 12 from each other. In this connection, one proceeds structurally in the manner that a support crossbar 20 formed by said portion is utilized. The latter and an outer edge 21 of the cap 8 on the side, or, better, the edge, hold the cover foil 15 at a distance from the cover 7 and even from the shoulder 10 so that the undergrip region designated 22 in the drawing is obtained.

A crossbar 23 which supports the cover 7 on its bottom provides additional support. The support crossbar 20 and the crossbar 23 are arranged one above the other. Both of them pass diagonally over the cap, doing so along the shorter axis of the oval in the case of an oval shape of the cap 8.

The crossbar 23 leaves windows 24 open. They extend substantially in coincidence with the upper openings 12, and permit the passage of the cap 8 which is also closed on its lower side except for the said windows 24. The cap 8 is to be considered practically a cage with respect to the elastic cover 7 gripped by it. The crossbar 23 extends in height substantially in the plane of the shoulder 10 between cap 8 and the lengthening outer wall 9 of the cap 8. The lengthening outer wall 9 is used to fasten the arrangement 8 on the neck 5 of the bottle. Its free end forms for this purpose an outwardly bent fastening flange 25. The latter comes against a corresponding mating flange 26 which protrudes from the outer wall 9 of the neck 5 of the bottle. The two flanges assume an annular course corresponding to the cross section of the neck of the bottle. They are connected in tightly sealing fashion to each other, for instance by thermal means. The sealing and suitably germ-blocking connecting joint bears the reference numeral 27.

An annular rib 28 developed on the inner side of the outer wall 9 enters, when the cap 8 is properly attached, into a groove 29 in the outer wall of the bottle neck 5. The annular rib 28 can be used in a first assembly step for forming a preliminary detent, in the manner that it rests on the upper outer edge between closure wall 6 and the outer wall of the bottle neck 5. The second assembly step is then the attachment shown.

The cover 7 can of course also be developed of circular shape, corresponding to the circular cross section of the bottle head 4; in the embodiment shown, however, the cap 8 is, to be sure, ring-shaped, but with a contour which passes into an oval shape. Whatever the contour may be, for the tight embedding of the puncturable cover 7 which withstands mechanical stresses there is a basic arrangement such that the edge region 30 of the cover 7 is in a gripping/form-locked engagement E with the cap 8. The outer wall 31 of the cap 8 has, for this purpose, two ring flanges I and II. With respect to the longitudinal center axis x—x of the arrangement A, they are spaced axially apart. Together with the peripheral outer wall 31, there thus results an edge mounting of U-shaped cross section, the U openings of the profile-like structure being open towards the center Z of the cover 7.

The axial spacing of this opening or surrounding openings corresponds to the thickness, measured in this direction, of the cover 7 or, for the reasons described further below, is somewhat less than that, so that even a clamping force which increases the sealing action is present.

In order to optimize the gripping/form-locked engagement E, ribs 32 are developed on the inner sides of the jaw-like ring flanges I, II. Each of the ribs engages into a corresponding groove 33 in the edge region 30 of the cover 7. The groove 33, which extends in a manner corresponding to the rib arrangement, extends both from the top and from the bottom of the cover 7. As a result of the groove/rib attachment to the cover 7 which is thus obtained, there is a clearly extended labyrinth-like joint region and thus an increased seal. The groove/rib attachment 32/33 thus obtained is not impaired upon passage of the cannula or of a spike of larger cross section. The outside flank 32' of the ribs 32 rather acts as abutment with respect to a tearing component which acts in the direction towards the center Z. The tearing component is indicated in the last figure by the arrow y.

The gripping/form-locked engagement E described between cover 7 and arrangement A is obtained by molding the cap 8 plus outer wall 9 and fastening flange 25 onto the edge region 30 of the cover 7. For this purpose, the preshaped cover shown in the figures is introduced into the mold cavity of an injection mold and molding effected around it, forming the cap, etc. The mold parts closing from the upper and bottom sides hollow out the openings 12 and the windows 24, and this while covering the troughs 14. The edge region 30, which acts as mold core permits the holding-claw-like ribs 32 to be produced.

In this connection an essential effect can be utilized:

The shrinkage which occurs upon the cooling increases the clamping force in the region of the gripping/form-lock engagement E, and presses these portions still more firmly together. The seal is optimized without the necessity of an integrating of the adjacent materials which are in contact with each other.

Figure 2:
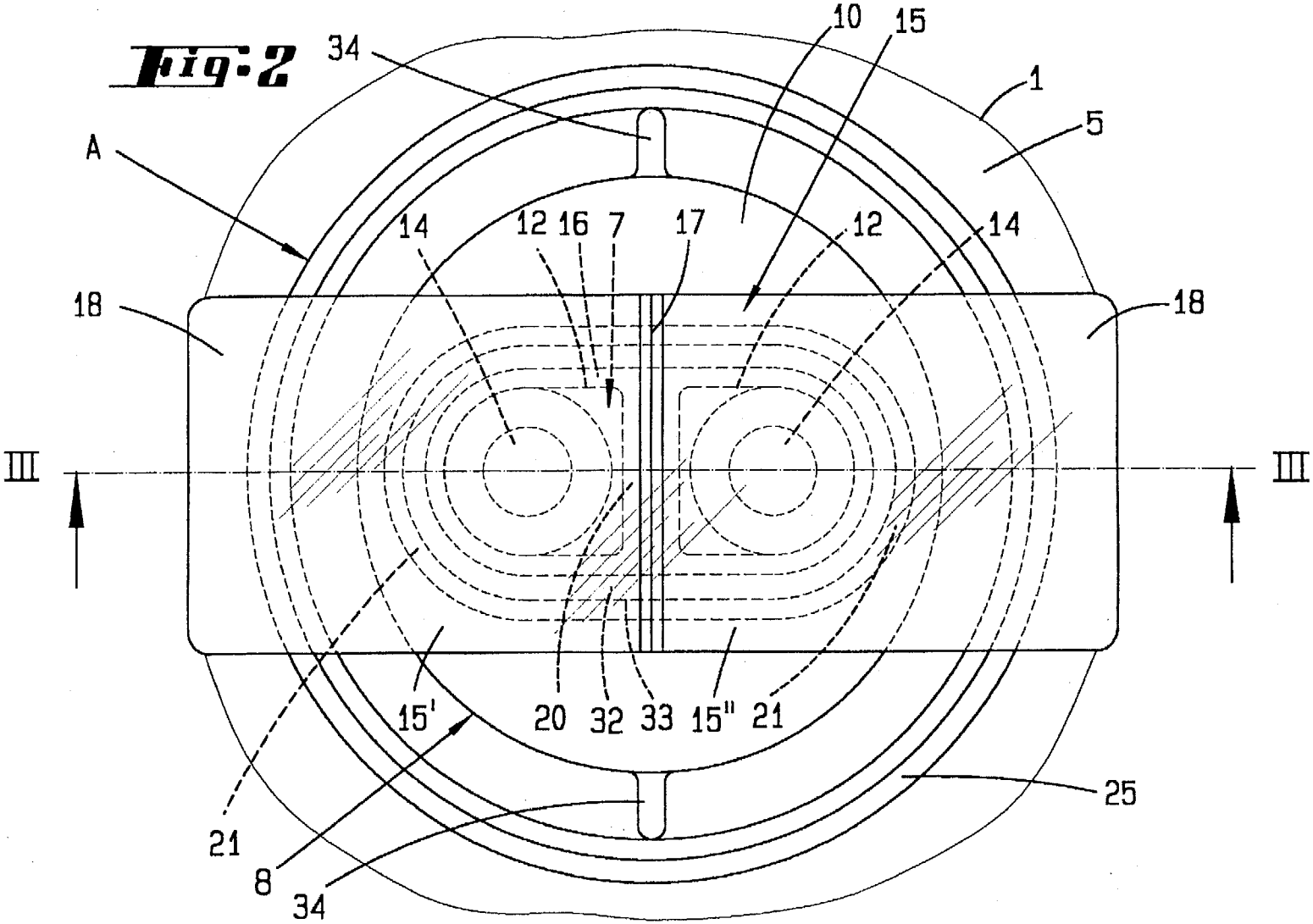
FIG. 2 is a top view of the arrangement.
Figure 3:
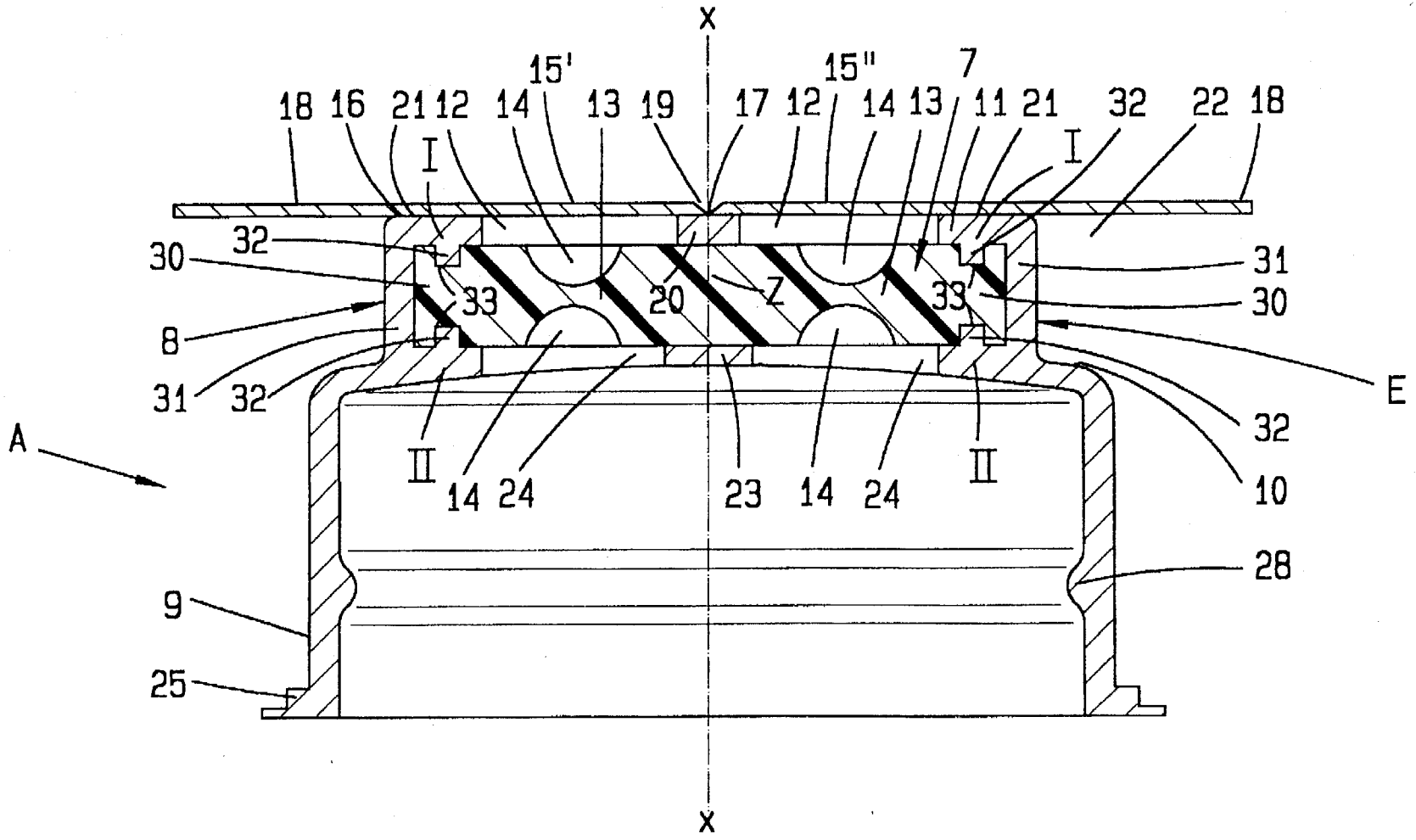
FIG. 3 is a section along the line III—III of FIG. 2.
Figure 4:
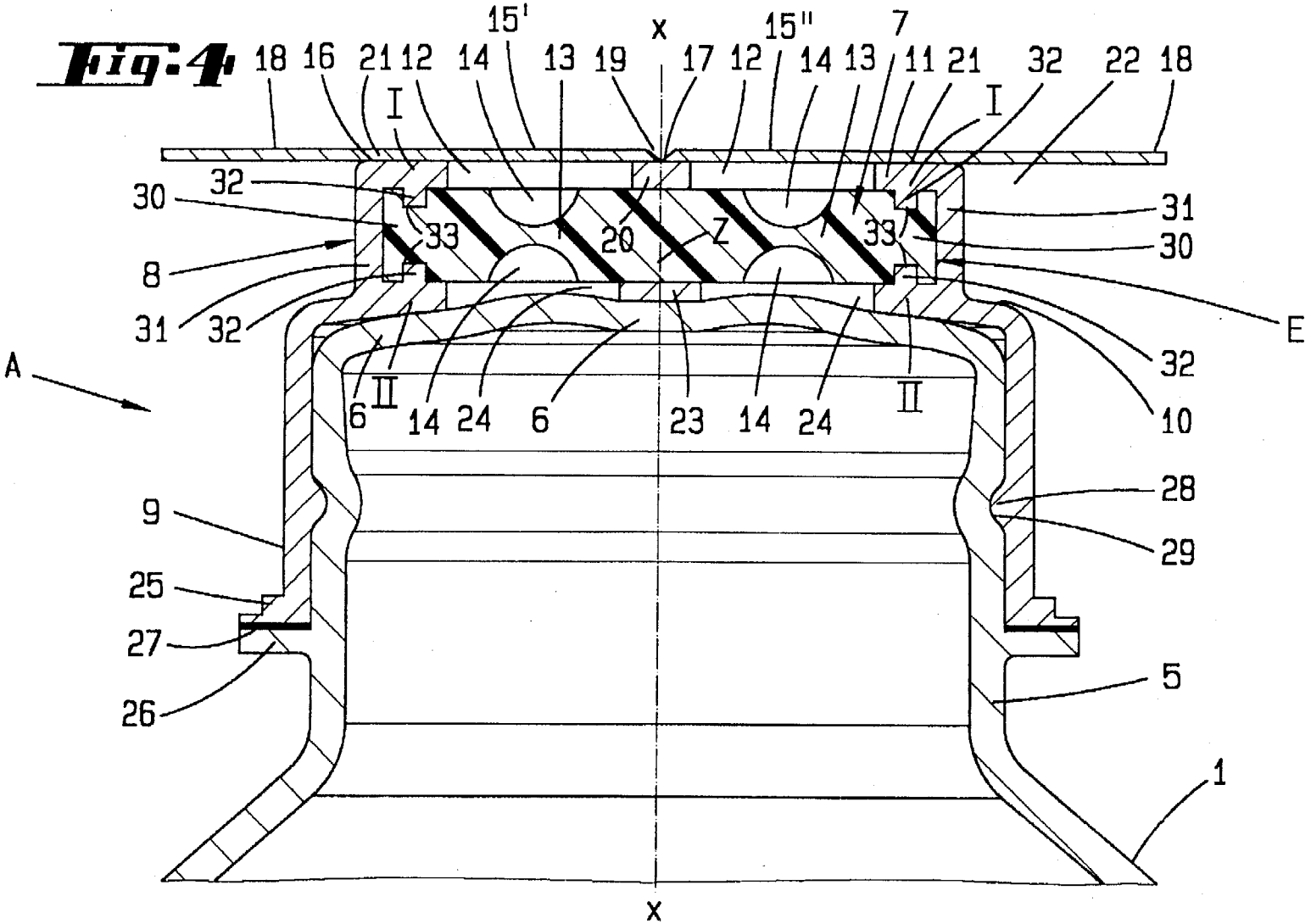
FIG. 4 is a section corresponding to FIG. 3, through the arrangement which is now associated with the infusion bottle.
Figure 5:
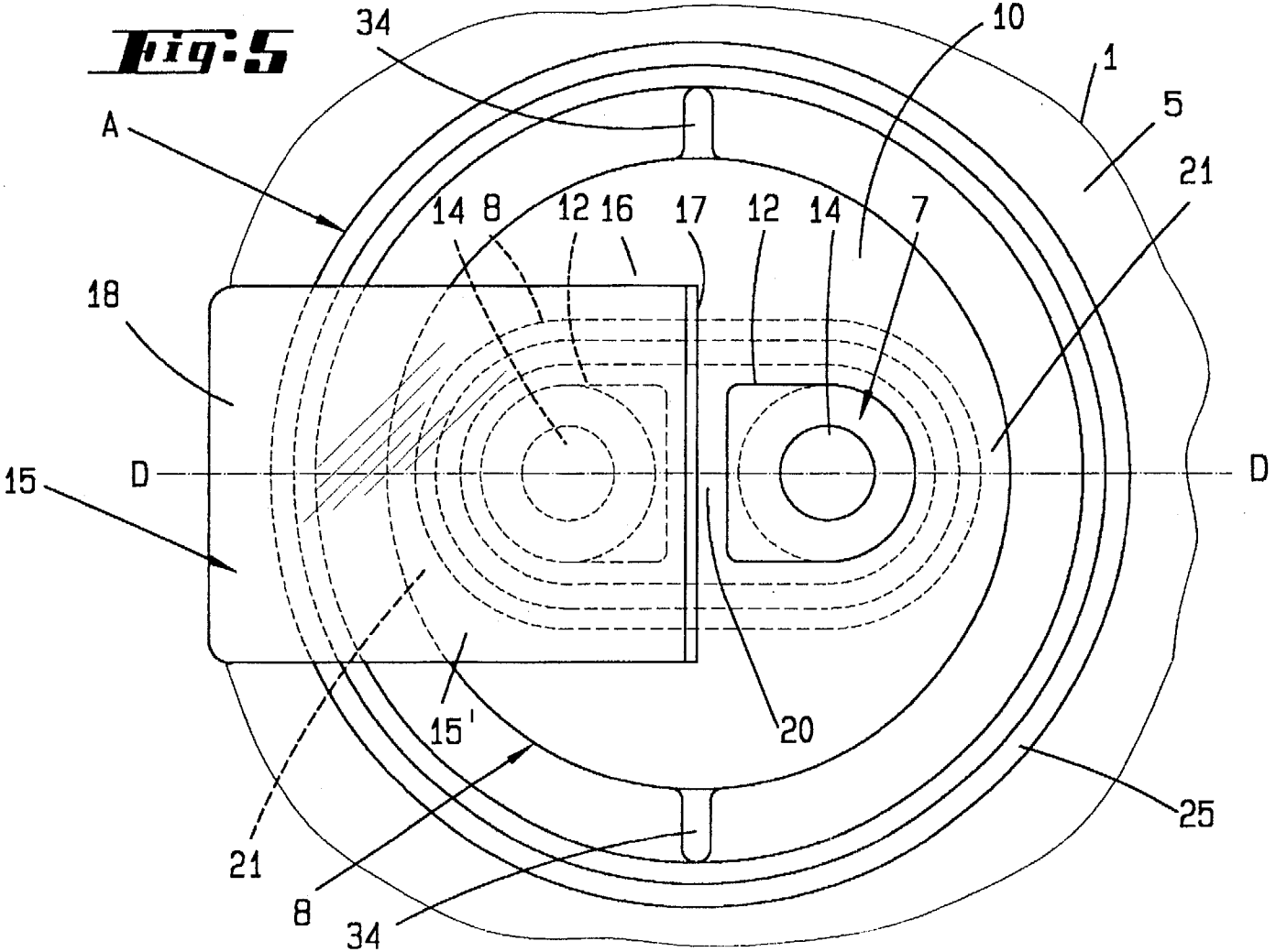
FIG. 5 is a top view of the arrangement of an exposed puncture region.
Figure 6:
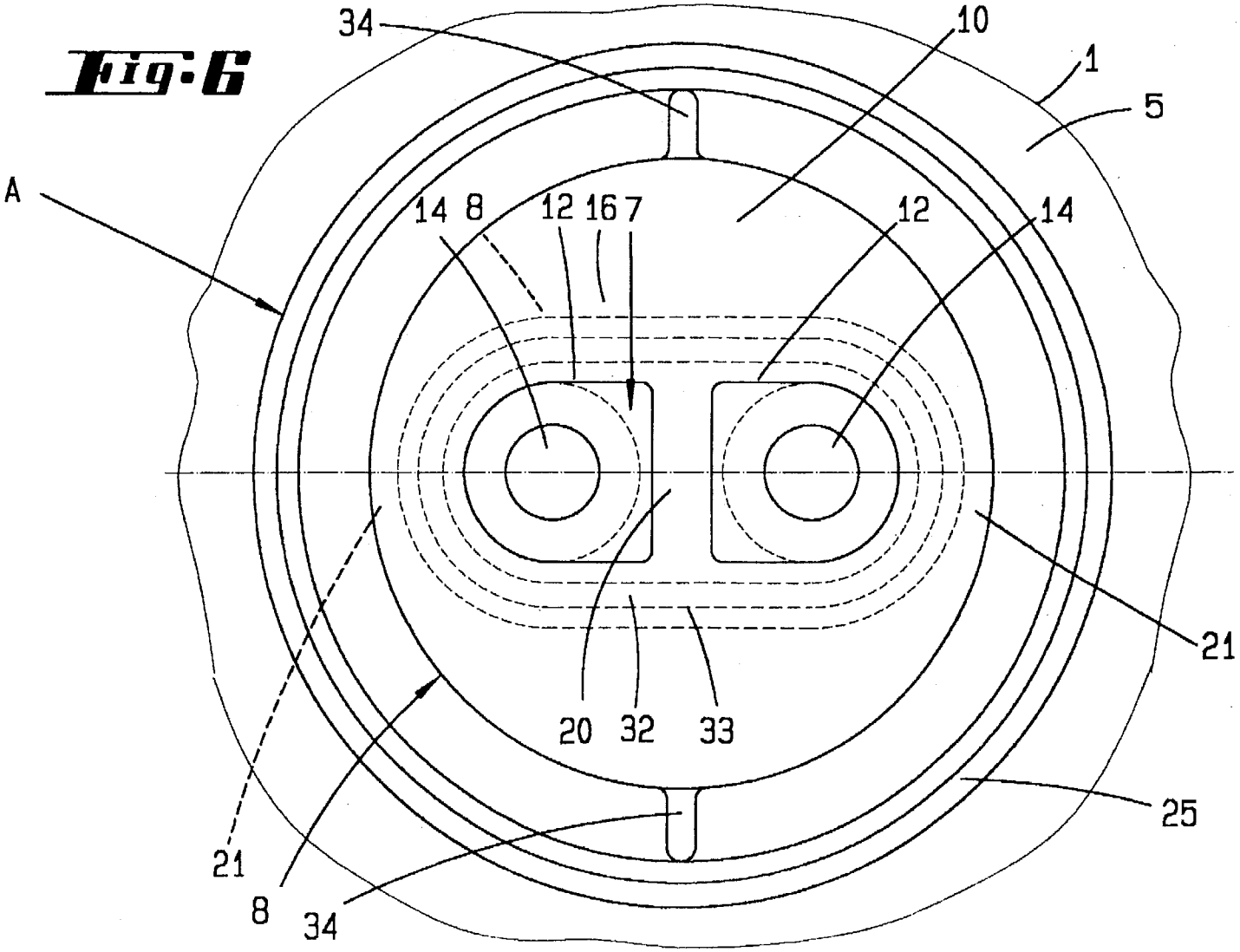
FIG. 6 is an identical top view of a second exposed puncture region.
Figure 7:
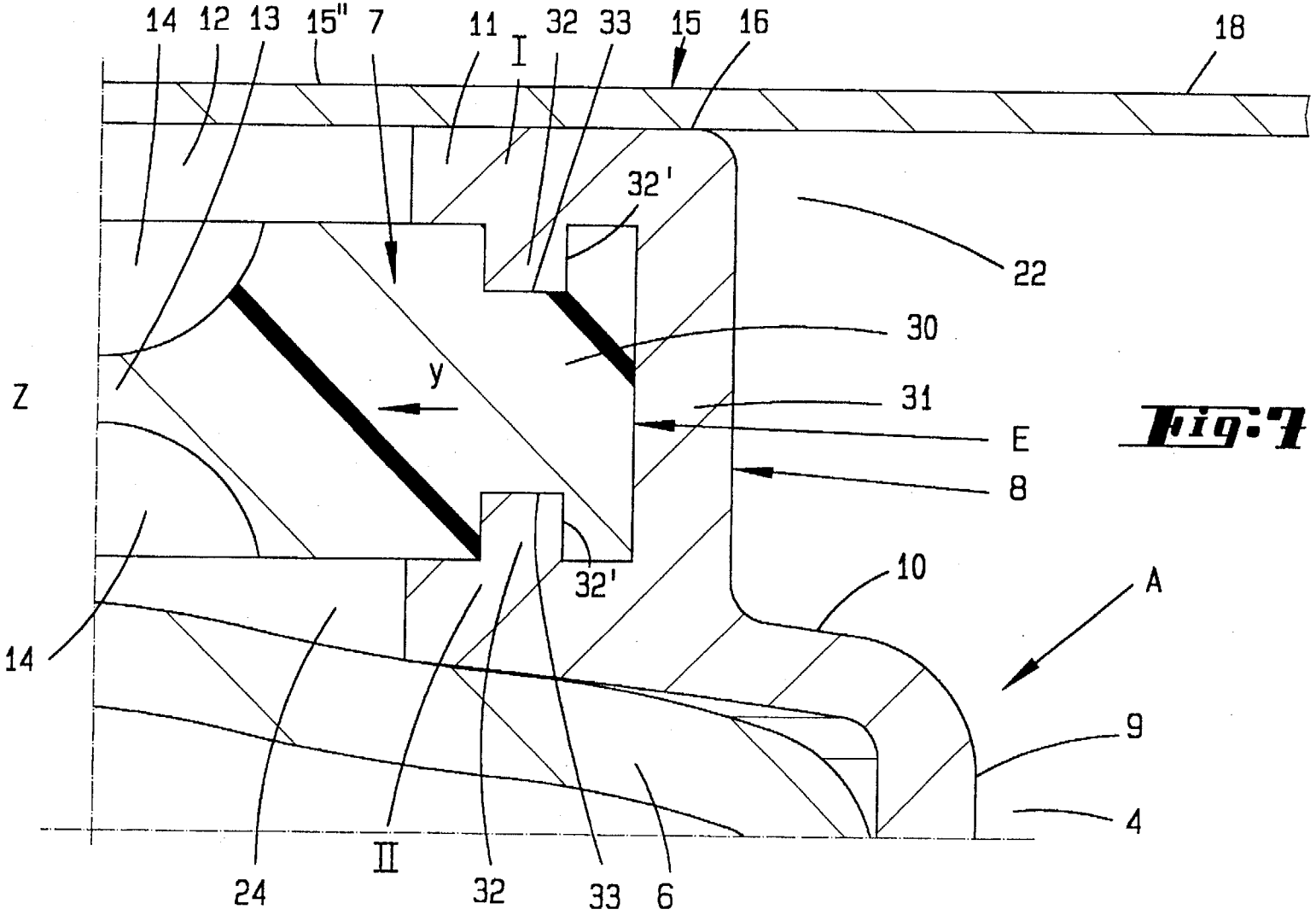
FIG. 7 shows, in an enlargement, the upper, right edge portion of the associated arrangement.

From the top side of the shoulder-like step 10 between cap 8 and outer wall 9, upward directed mold-on crossbars 34 extend. They end shortly below the top 16 of the cap 8. Said crossbars 34 extend in regions which are not covered by the cover foil 15; see FIG. 2. Despite the plateau-like elevation of the cap 8, there is good accessibility for the molding.

The mold-on crossbars 34 are not only rooted in the said step 10, but they also extend into the possibly parallelly extending sections of the outer wall 31 of the plainly exposed cap 8. They therefore, at the same time, form radial stiffening struts, so that the wall thickness of the arrangement A can be made very thin.

With regard to the contour of the openings 12 and windows 24, it remains to point out that the latter are circular and the former have a U-shaped contour, the support crossbar 20 which crosses the cap 8 extending in front of the end of the U arms. The trough 14 is concentric to the U crossbar which, correspondingly, extends also circularly (semicircle).

I claim:

1. A cover assembly for use on an infusion bottle, comprising:

a cap with an encircling outer wall and a crossbar extending across the cap to connect with the outer wall;

a cover with plural foil-covered puncture regions, the cover being held by a cap, the cover extending across the cap on a first side of the crossbar;

a foil extending above the cover across the cap on a second side of the crossbar opposite said first side of the crossbar and spaced apart from the cover by the crossbar, the first side of the crossbar facing a puncturable closure wall of the bottle upon emplacement of the cover assembly upon the infusion bottle;

wherein the foil has an intended tear line between the puncture regions of the cover and includes gripping tabs which protrude beyond the outer wall of the cap on both sides of the intended tear line.

2. The cover assembly according to claim 1, wherein the intended tear line lies as an embossed line supported by the crossbar.

3. The cover assembly according to claim 2, wherein the crossbar and a lateral outer edge of the cap hold the foil spaced from the cover and from an adjoining shoulder of the cap.

4. The cover assembly according to claim 1, wherein said crossbar is a first crossbar, and said cover assembly further comprises a second crossbar which extends below the cover between the puncture regions of the cover.

5. The cover assembly according to claim 4, wherein the cap further comprises a depending wall which overlaps a neck of the bottle upon emplacement of the cover assembly on the bottle; and the crossbar extends substantially in the plane of a shoulder of the cap above the depending wall.

6. A cover assembly for use on an infusion bottle having a puncturable closure wall, the cover assembly comprising:

a cap having an encircling outer wall and a crossbar which connects with the outer wall and extends across the cap, the cover assembly being adapted to cover the closure wall of the bottle;

a cover extending within an interior portion of the cap to the outer wall, the cap being configured for placing the cover in front of the closure wall upon emplacement of the cover assembly on the bottle;

a foil supported by the crossbar and extending across the cap to cover the cap, the foil extending beyond the outer wall of the cap to form grip tabs;

wherein the foil has a plurality of foil sections separated by an intended tear line, the intended tear line extending along the crossbar;

the cover has a plurality of puncture regions which are each covered by said respective foil sections;

the intended tear line serves for a forming of the foil sections, the grip tabs being on opposite sides of the intended tear line and protruding beyond the periphery of the cap; and the crossbar, in sterile fashion, separates the puncture regions from each other, the crossbar being arranged below the intended tear line between the foil and the cover.

7. The cover assembly according to claim 6, wherein the intended tear line comprises an embossed line.

* * * * *